United States Patent [19]

Andersson et al.

[11] 4,091,262

[45] May 23, 1978

[54] ELECTRICAL ENERGY SUPPLIED HEAT-EMITTING RADIATOR

[76] Inventors: Verner Andersson, Stationsgatan 1B, 824 00 Hudiksvall; Hans Jonason, Rubinvagen 29, 952 40 Sundsvall, both of Sweden

[21] Appl. No.: 672,064

[22] Filed: Mar. 31, 1976

[30] Foreign Application Priority Data

Apr. 2, 1975 Sweden ..... 7503759

[51] Int. Cl.[2] ..... F24H 9/08; F24D 13/02; H05B 3/02

[52] U.S. Cl. ..... 219/345; 219/351; 219/352; 219/356; 219/536; 219/537; 219/539; 219/541

[58] Field of Search ..... 219/339, 341, 342, 345, 219/350, 351, 352, 353, 355, 356, 357, 358, 213, 366, 368, 534, 537, 541, 547

[56] References Cited

U.S. PATENT DOCUMENTS

| | | | |
|---|---|---|---|
| 1,524,075 | 1/1925 | Yokel | 219/342 |
| 2,495,788 | 1/1950 | Trist | 219/352 |
| 2,502,147 | 3/1950 | Grothouse | 219/345 |
| 2,569,961 | 10/1951 | Tidd | 219/345 |
| 2,613,309 | 10/1952 | Frere | 219/345 |
| 2,709,576 | 5/1955 | Marggraf | 219/345 |
| 2,784,286 | 3/1957 | Dillon | 219/537 |
| 2,861,168 | 11/1958 | Knoll | 219/345 |
| 3,026,393 | 3/1962 | Quirk | 219/364 |
| 3,132,230 | 5/1964 | Laug | 219/366 |
| 3,155,812 | 11/1964 | Greenhaus | 219/345 |

*Primary Examiner*—J. V. Truhe
*Assistant Examiner*—Bernard Roskoski
*Attorney, Agent, or Firm*—Burns, Doane, Swecker & Mathis

[57] ABSTRACT

A heat-emitting radiator supplied with electrical energy and preferably capable of co-acting with two holding means in conjunction with a radiator-supporting means, such as a wall. The holding means associated with the radiator comprise a first rail preferably having current-conducting means, and a second rail. One or more cassettes being insertable between the rails. Each cassette has a contact means for cooperating with the contact rail. Each cassette is further arranged to be inserted in the first rail and the second rail in a first position of rotation. The cassette is arranged to be held in the rails in a second position of rotation.

16 Claims, 11 Drawing Figures

ELECTRICAL ENERGY SUPPLIED HEAT-EMITTING RADIATOR

FIELD OF THE PRESENT INVENTION

The present invention relates to a heat-emitting radiator, which is supplied with electrical energy and which preferably cooperates with two securing means associated with a device for supporting the radiator, such as a wall.

DESCRIPTION OF THE PRIOR ART

It is previously known to manufacture electrical radiators of specific form and power output. Owing primarily to storage problems, it has been necessary to restrict the number of commercially available radiators. These radiators have been manufactured to produce a predetermined maximum power output. It is therefor impossible to adapt the maximum output of the radiator to the space to be heated.

It has long been desired to produce radiators in a rational manner which are capable of being adapted to spaces of different size, by permitting the radiator to operate through different power output ranges with small differences, at the same time as the different elements of the radiator can be readily manufactured and are easy to handle for storage purposes.

OBJECTS OF THE PRESENT INVENTION

The present invention is intended to eliminate these disadvantages and to provide a heat-emitting radiator supplied with electrical energy which is constructed from a number of standard elements one of which is referred to hereinafter as a cassette, and by means of which the radiator can be readily adapted with respect both to size and power output in accordance with the space to be heated.

A radiator which can be assembled from standard elements is previously known to the art. The construction of such radiators, however, is complicated and considerable effort has been made to protect the electric voltage conductors which lie freely in a rail.

The radiator according to the present invention can be readily assembled owing to the fact that each cassette is arranged to coact with an upper, first rail and a lower, second rail, the rails being secured in a simple manner to a radiator-supporting device, such as a wall. A number of cassettes adjusted and corresponding to the desired output value can thus be introduced between the rails. Each radiator thus constructed is provided conveniently with a terminal cassette through which voltage and current can be passed to a conducting means arranged in the first rail, which conducting means is connected through electrical contacts with heat emitting cassettes or heating rods.

MAIN CHARACTERISTIC FEATURES OF THE PRESENT INVENTION

The main characteristic features of a heat-emitting radiator supplied with electrical energy and constructed in accordance with the present invention are the fact that each cassette has a contact means for cooperation with the contact rails, that each cassette is arranged to be inserted in the first rail and the second rail in a first position of rotation, and in that the cassette is arranged to be held in the rails in a second position of rotation.

BRIEF DESCRIPTION OF THE DRAWINGS so that the inventon will be more readily understood and further features thereof made apparent, exemplary embodiments of the invention will now be described with reference to the accompanying drawing, in which FIG. 1 shows in perspective view a radiator constructed in accordance with the invention positioned beneath a window of a room, said radiator comprising a connecting cassette which incorporates a thermostat, and with a cassette (the second) removed for illustrative purposes and a cassette is shown in dotted lines in readiness for insertion between the rails.

DESCRIPTION OF THE PREFERRED EMBODIMENT

Figure 1:
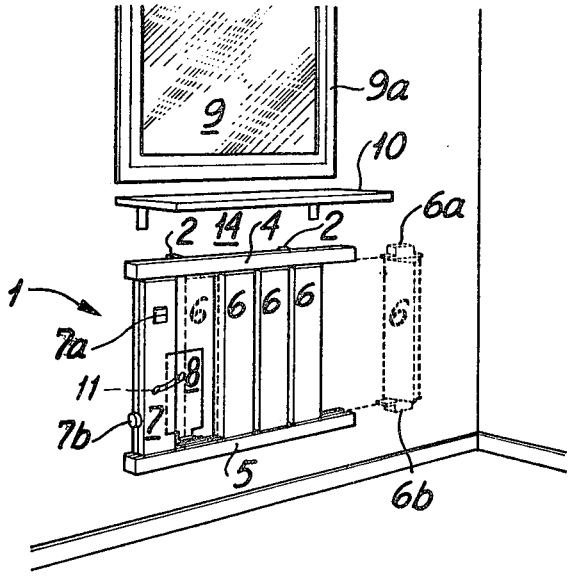

In FIG. 1 there is shown in perspective view a radiator having a connecting cassette 7 provided with a thermostat 7b and placed beneath a window of a room. Although described with reference to the illustrated embodiment, it will readily be perceived that the connecting cassette 7 may be omitted or can be provided without a thermostat. The radiator is generally identified by the reference 1 and comprises a heat-emitting radiator supplied with electrical energy. The radiator 1 includes a plurality of cassettes 6 each of which cooperates with an upper, first rail 4 and a lower, second rail 5. Each of the rails 4 and 5 is carried by two securing means 2, of which only those which co-operate with the rail 4 are shown in FIG. 1. The securing means 2 are identical for both rails 4 and 5. The securing means 2 are mounted to a device supporting the radiator as a whole, which in the illustrated embodiments of FIG. 1 is in the form of a wall 14. In the illustrated embodiment, the upper, first rail 4 has the form of a contact rail provided with internally arranged bare electric voltage conductors. The lower, second rail 5 is in the form of a guide rail.

The radiator comprises one or more cassettes 6 which can be securely mounted between the rails 4 and 5. Mounting of respective cassettes 6 is effected by inerting an upper and lower connecting portion 6a and 6b respectively of a cassette into respective rails 4 and 5. The connecting portions 6a and 6b are identical (with the exception that the upper connecting portion 6a is provided with a necessary contact spring for transferring electrical energy from electrical conductors arranged in the rail 4 to heating coils or resistance lines in the cassette and are pivotally connected to the cassette 6. The cassette 6 is arranged to be inserted in the contact rail 4 and the guide rail 5 in a first position of rotation but is held by the contact rail and a guide rail in a second position of rotation. The first position of rotation is shown in ghost lines in FIG. 1 while the cassettes shown in FIG. 1 occupy their second position of rotation. The upper connecting portion of each cassette is provided with contact means for co-operating with current conducting means, incorporating in the contact rail 4. With the cassette 6 in its first position of rotation relative to the connecting portions 6a and 6b, the contacts adopt a withdrawn position and no voltage can be applied to the cassette before the cassette is rotated to its second position of rotation, in which the contacts are caused to co-operate with the voltage conducting conductors.

The radiator 1 in the FIG. 1 embodiment is also provided with a connecting cassette 7. The connecting cassette 7 is provided with a thermostat 7b and a switch 7a. Supply voltage enters through a cable 11 to the lower portion of the connecting cassette 7 and can be conducted through an electrical conductor incorporated in the cassette 7 to a conductive means incorporated in the contact rail 4 via the switch 7a and the thermostat. In the embodiment of FIG. 1, the connecting cassette 7 is not arranged to emit heat. The cassettes 6, on the other hand, will emit heat immediately when the conducting means in the rail 4 are energized. The thermostat 7b is connected up in a known manner.

A connecting plate 8 is capable of being mounted at any position along the guide rail 5 through securing means, in a manner such that the plate 8 can be arranged in the vicinity of the supply lines of the radiator fron cable 11 extending from the plate 8 and the connecting cassette 7.

In FIG. 1, the window is shown at 9, the window frame at 9a. Arranged beneath the window is a shelf 10.

Figure 2:
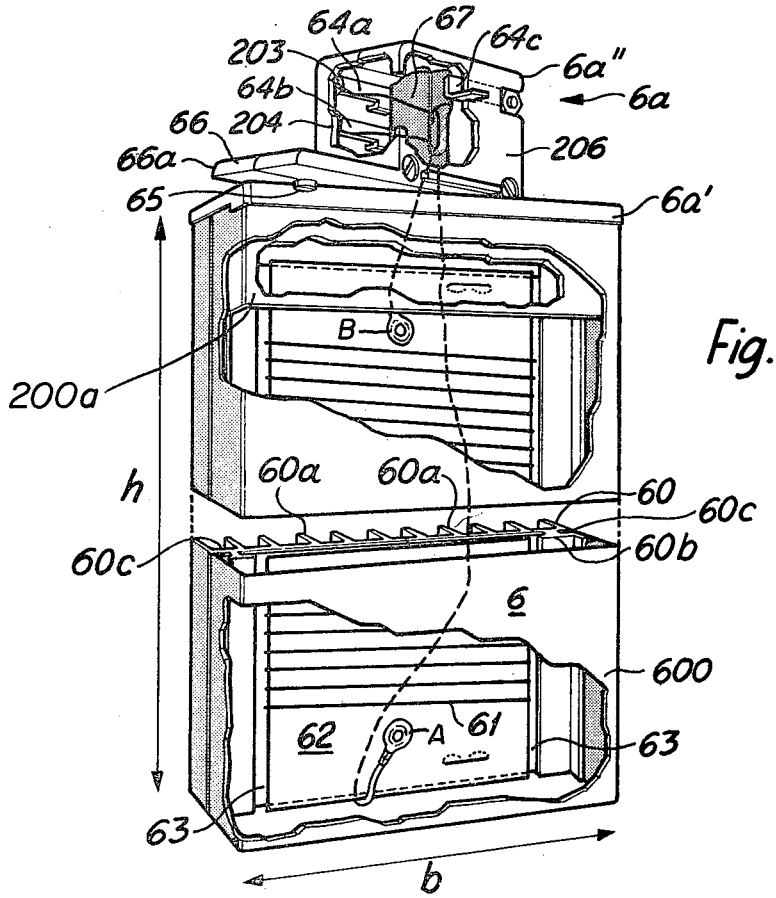
FIG. 2 shows in perspective view a partial sectional view of a cassette provided with resistance means, a lower connecting portion of the cassette being removed for illustrative purposes.

Each cassette 6 has a pre-determined power output and the power output of the radiator as a whole thus depends on the number of cassettes 6 arranged therein. Each cassette will have the same power development, although there is nothing to prevent adjacently located cassettes from having mutually different power development. It is convenient for each cassette to emit heat corresponding to 100 watts. FIG. 2 shows in perspective and in section view a cassette 6 provided with resistance means. The resistance means 61 may have the form of an electric resistance coil and is wound around an electrically insulated carrier 62 mounted on a further electrically insulated carrier 63, the edge portions of which are inserted in grooves in the main portion 60 of the cassette. The main potion of the cassette has a width "*b*" which constitutes a pre-determined measurement. Further the main portion 60 has a height "*h*" which corresponds to the distance between the contact rail 4 and the guide rail. Arranged on the upper portion of the cassette is an upper connecting portion 6a. The lower portion of the cassette is provided with a lower connecting portion 6b, which is not shown in FIG. 2. The upper connecting portion 6a is arranged to co-act with the contact rail 4 while the lower connecting portion 6b is arranged to co-act with the guide rail 5. The cassette is inserted between the rails 4 and 5, said upper connecting portion 6a being inserted into one end portion of the contact rail 4 and the lower connecting portion 6b being inserted in one end portion of the guide rail 5. The main portion 60 of the cassette is arranged to adopt a first position of rotation relative to the contact rail and the guide rail 5. The upper connecting portion 6a is provided with two contact pins 64a and 64b which face toward one side of said upper portion and a contact pin 64c which faces toward the other side of said portion. The contact pins 64a and 64b are intended to co-act with electrical conductors arranged in the contact rail 4, while the contact pin 64c is intended to co-act with ground potential. In the illustrated embodiment the contact rail 4 comprises an electrically conductive material, such as an aluminum profile, and the contact pin 64c is arranged to abut the inner surface of said profile. It will readily be perceived that the contact pin 64c may be omitted when the installation is such that the radiator need not be grounded or earthed. The cross sectional surface of the upper connecting portion 6a perpendicular to the longitudinal axis of the contact rail 4 corresponds substantially to the inner cavity of the contact rail 4. Similarly, the shape of the lower connecting portion 6b corresponds to the inner cross sectional shape of the guide rail 5.

The connecting portions 6a are pivotally mounted on the main portion 60 of the cassette 6. The connecting portion 6a comprises two parts 6a'' and 6a', where the part 6a' is securely connected to the main portion 60 by means of flange 200a and exhibits a shaft 67 whose axis extends from said main portion 60. The part 6a'' is rotatably arranged about said axis. A peg 65 is arranged beneath a planar portion 66 of the part 6a', said peg 65 being intended, in the second position of rotation (the first position of rotation is shown) to snap into a recess or a hole in the upper planar surface of the part 6a'. The hole is not shown in FIG. 2. The peg 65 has a planar portion 66 and co-acts with the hole when said portion is parallel with the main portion 60. As will be seen from FIG. 2, the planar 66 extends beyond the main portion 60 (has a length which exceeds the width "*b*." This means that the edge surface 66a abuts a corresponding surface of an adjacently located cassette. Those parts of the planar portion 66 which extend beyond the main receive 60 form a protection against touching of the voltage-carrying conductors in the rail 5 in the place formed between each cassette 6.

The upper portion 6a includes a shaft 67, the nature of which will be described in more detail hereinafter.

Figure 3:
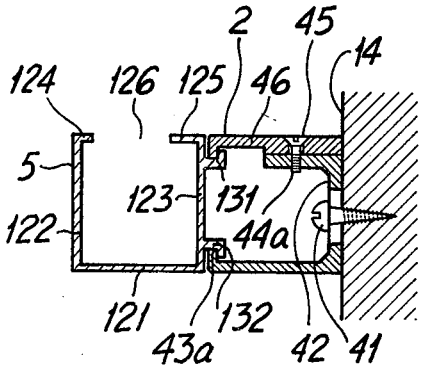
FIG. 3 shows in perspective view a sectional view of the manner in which one of said rails co-acts with a cassette and with retaining means for said rail.

The main portion 60 of a cassette 6 comprises an aluminum profile. This profile is provided with ribs 60a which face toward the wall 14. The profile 60 exhibits manually opposing grooves 60b which received and carry the carrier 63 for the heating coil 61. The profile 60 also exhibits grooves 60c which face away from each other and which carry an outer cover 600, which cover may comprise a synthetic resin profile so as to reduce surface temperature. FIG. 3 shows one of the two rails 5 and securing means 2 intended therefor in side view and in section. The securing means 2 are mounted on radiator supporting means, such as the wall 14. Mounting of the radiator is effected through two adjacently located screws 41 which tighten a flange portion 42 against the wall 14. Extending from the flange 42 are two arms 43 and 44. The arm 43 is the lower arm and extends a longer distance from the wall 14 than the arm 44. The free end of the arm 43 has an edge 43a which is intended to co-act with a corresponding recess in the rail 5. The arm 44 is approximately half as long as the arm 43 and is provided with a screw threaded hole 44*a*. Co-operating with the screw threaded hole is screw 45 which tightens an upper holding member 46 against the arm 44. In a similar manner to the arm 43, the upper holding member 46 has an edge 46*a* which is intended to co-act with a corresponding groove in the rail 5. When mounting the contact rail 5, the upper holding member 46 is removed by releasing the screw 45 against the arm 44 in the threaded hole 44*a* therein. The hook formed on the contact rail 5 is engaged with the edge 43*a* of the arm 43, whereafter the edge 46*a* on the upper holding member 46 is engaged with its respective recess in the rail. The upper holding member 46 is then tightened against the arm 44 by means of the screw 45.

Figure 4:
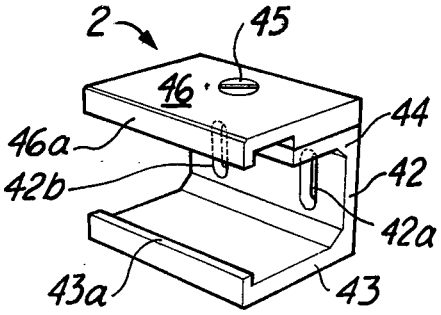
FIG. 4 shows in perspective view the retaining means shown in FIG. 3.

FIG. 4 shows in perspective view a securing member 2 used with the FIG. 3 embodiment. For the sake of clarity, the securing member is shown out of engagement with the contact rail 4. As will be seen from FIG. 4, the flange portion 2 of the securing member 42 has two recesses 42*a* and 42*b*, which are intended to co-act with respective screws 41. The arms 43 and 44 are mutually parallel and extend perpendicularly relative to the flange portion 42. The screw 45 holds the upper holding member 46 to the arm 44 in the manner aforementioned. Both edges 43*a* and 46*a* have a length corresponding to the width of the securing member and exhibit a substantially square cross sectional shape.

As previously mentioned the cassettes are mounted by inserting respective cassettes between the contact rail 4 and the guide rail 5. The requisite number of heating rods are inserted so that their side edges 66*a* sealingly abut one another, which means that a space is present between adjacently located cassettes. The planar portions 66 cover the bare current conductors in the rail 4.

Figure 5:
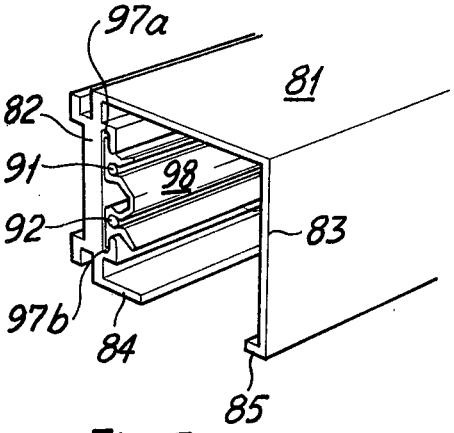
FIG. 5 shows a first rail or contact rail having two electrically conductive means.

FIG. 5 show in perspective view a contact rail 4 having two electrical conductors 91 and 92 but lacking the special grounding or earthing means, since the rail itself acts as an earth connection. As will be seen from FIG. 5, the contact rail has an upper surface 81 and two side surfaces 82 and 83 and two lower surfaces 84 and 85.

As will be seen from FIG. 5, the side surface 82 has inner grooves 97*a* and 97*b* which extend along the contact rail. The current-carrying conductors 91 and 92 are arranged on the surface 82 and are held in position in the rail 4 by an electrically insulated portion 98. The portion 98 is held in a pre-determined position by means of the inner grooves 97*a* and 97*b* in the contact rail.

FIG. 3 is a side view of the guide rail 5 for the cassettes, said guide rail having a horizontally extending surface 121, two vertically extending surfaces 122, 123 and two upper surfaces 124 and 125. The surfaces 124 and 125 form a longitudinally extending groove 126 through which part 6*b* of the cassettes are able to pass. The hooks 131 and 132 intended for holding the guide rail are shown in FIG. 2, said hooks being included to illustrate the manner in which they co-operate with the securing means 2.

In accordance with the invention, the contact rail 4 and the guide rail 5 are preferably manufactured in continuous lengths. For this purpose, the rail 4 may have the same cross sectional shape as the rail 5. The length required can then be cut at the assembly site and the ends of the contact rail 4 and the guide rail 5 provided with end covers.

Figure 6:
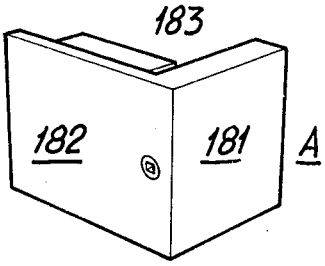
FIG. 6 shows two perspective views A and B of an end cover which can be mounted to the contact rail and/or guide rail.

FIG. 6 shows two views A and B of such covers. The end covers are angular in shape having part 181 and 182. The part 181 supports a guide portion 183 which is intended to be inserted into the space of a rail 4 or 5, while the portion 182 presents grooves 182*a* and 182*b* for cooperation with the part 131 and 132. Shown in the Figure is locking device 184 which extends through a guide portion 185. The locking device 184 comprises a shoulder which is rotatable to a position forming an angle of 90° to that shown. The shoulder 184 in this position firmly secures the cover to the rail 4 or 5.

Figure 7:
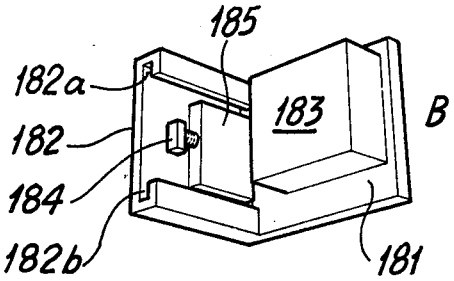
FIG. 7 shows two horizontal sectional views A and B of the upper connecting portion having a cam disc for actuating electrical contacts.
Figure 7:
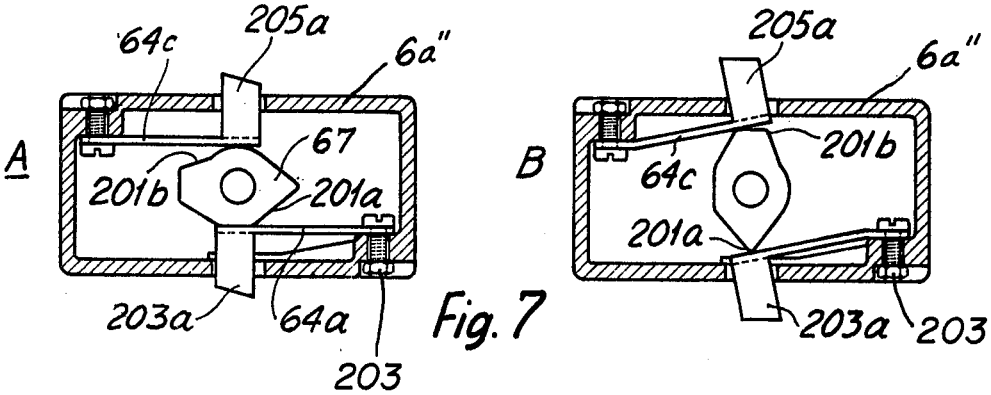

FIG. 7 shows two different positions, A and B for the contacts in the upper connecting member 6*a* depending upon the position of the shaft. This will be described in more detail hereinafter.

Figure 8:
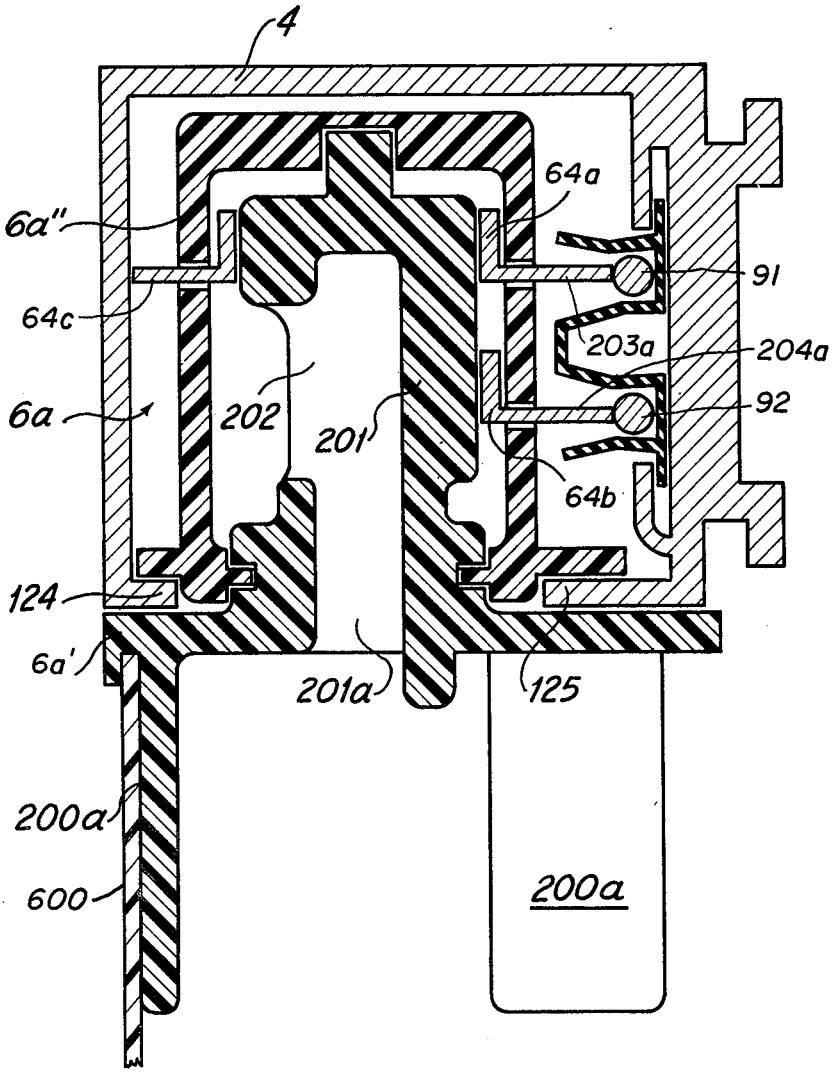
FIG. 8 is a sectional view of the upper connecting portion in a position in which the electrical contacts are actuated (FIG. 7B).

FIG. 8 is a sectioned side view of the connecting portion 6*a* arranged on the upper part 60 of the main portion and shows that the connecting lines (not shown) for the heat-emitting element or resistant element may pass through a central hole 201*a* in a shaft 67 and out through a diametrically arranged hole 202 in the same shaft. These lines are connected to screws 203 and 204 (FIG. 2) which are fixedly arranged on a respective contact spring 203*a* and 204*a*, (64*a*, 64*b* in FIG. 2). The part 6*a*′ has flange 200*a* which can be passed down and into the upper portion 60 of the cassette 6. The flange 200 is adapted to fit inside casing 600 and about upper part 60 to rigidly attach planar portion 66 and its attached shaft 67 to casing 600 of cassette 6 so that shaft 67 will rotate with cassette 6. The shaft 67 is securely connected to the part 6*a*′ and is carried by a planar portion 66 supporting a housing 6*a*″ . The part 66 and the housing 6*a*″ are rotatably arranged in relation to each other.

FIGS. 7A and 7B show the shaft 67 in a horizontal view. It is assumed that the housing 6*a*″ is guided by the rail 4 and that rotation of a cassette 6 causes rotation of the shaft 67. The shaft 67 has a surface 201*a* which, upon rotation from the first position of rotation towards the second position of rotation, urges the contact surface 205*a* of pin 64*c*, the earth contact, towards the inner surface of the rail 4, and upon continued rotation the surface 201*b* urges the two contacts surfaces 203*a* and 204*a* of pins 64*a* and 64*b*, respectively, against the current-carrying conductors 91 and 92. There is nothing to prevent the surfaces 201*a* and 201*b* from pressing against the actual contact spring, the end of which affords requisite contact pressure between the contact 203*a* and the voltage-carrying conductors 91 and 92.

Figure 9:
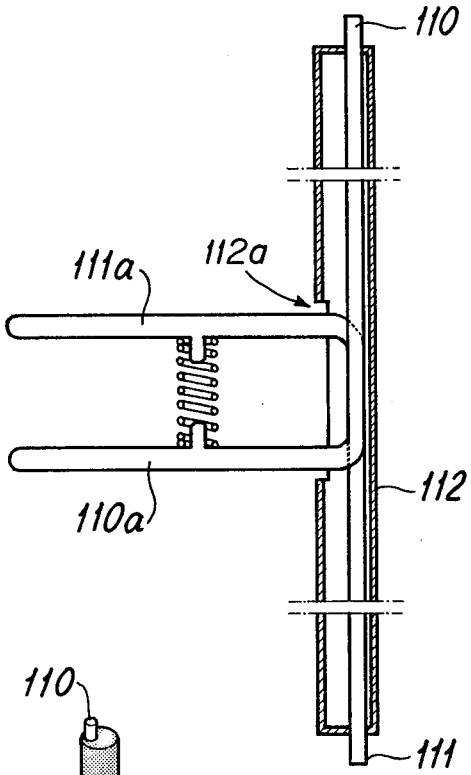
FIG. 9 is a sectional side view of a tool for facilitating the removal of a cassette from between said rails.

It is proposed that both the upper and the lower parts 6*a*, 6*b* are each provided with a peg 65 which in the assembled position of the cassette co-acts with a respective hole. When a cassette is to be removed, the portions 66 must be bent from each other to an extent such that the pegs 65 no longer co-operate with corresponding holes, whereafter the cassette is rotated fron its second position of rotation to its first position of rotation and removed from the rails 4 and 5. To facilitate this there is used a tool, such as that shown in FIG. 9. One leg 110 of the illustrated tool is arranged to bear against the under surface of portion 66 in the part 6*a* and the other leg 111 is arranged to abut the upper surface of portion 66 in part 6*b*. The leg 110 is angular and forms a handle 110*a*. The leg 111 is bent at an angle and forms a handle 111*a*. By pressing the handles 110*a* and 111*a* towards each other, the portions 66 will bend away from each other and the pegs 65 will cease to engage the holes, which enables the cassette to be rotated to its first position of rotation.

Figure 10:
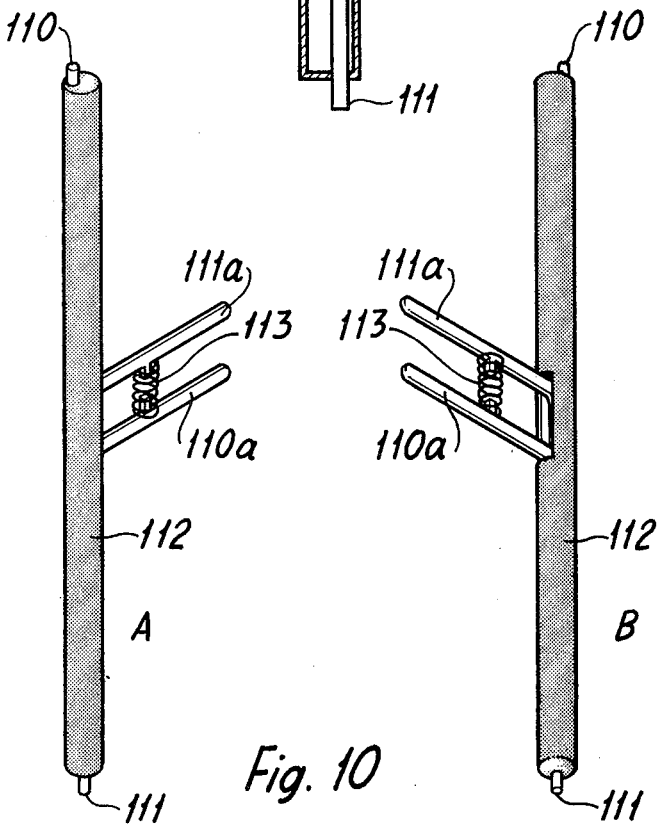
FIG. 10 shows two perspective views A and B of a tool according to FIG. 9.
Figure 11:
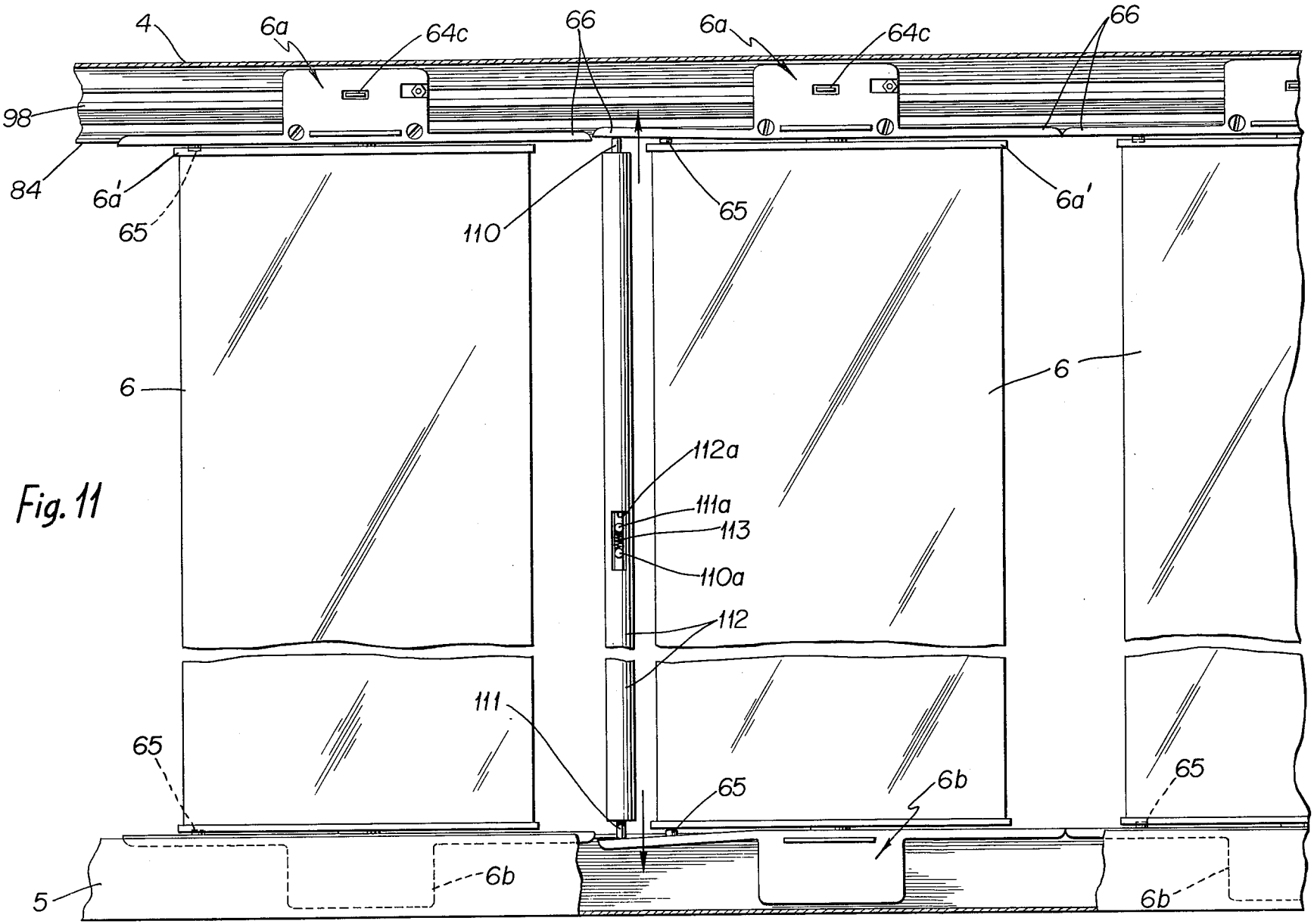
FIG. 11 shows an elevation view of cassettes locked in operating position and spaced apart and the action of a tool used to unlock the cassettes.

FIG. 10 shows two perspective views of the tool shown in FIG. 10. It will be seen from FIG. 10, that the legs 110 and 111 are guided in a casing 112 and that the handles 110*a* and 111*a* are biased away from each other by spring 113. The casing 112 has a recess 112*a* through which the handle 110*a* and 111*a* extend.

The connecting plate 8 shown in the figures may advantageously be provided with a coupling device for connecting the ends of the supply lines.

What is claimed is:

1. A heat-emitting radiator supplied with electrical energy and adapted for mounting on a building interior structure such as a wall, comprising:

a channel-shaped contact rail adapted for mounting on a structure and including current conducting means inside said contact rail and means for connecting said current conducting means to a source of electrical power;

a guide rail also adapted for mounting on the structure in spaced apart relationship from said contact rail;

at least one heating cassette supported by said guide rail and said contact rail and including a heat-emitting resistance means fed by current applied to said current conducting-means of said contact rail; and, contact means rotatably disposed on each of said at least one cassette electrically connected to said resistance means of said at least one cassette and cooperating with said contact rail and adapted for insertion into the channel of said contact rail in a first deenergized position of rotation and furthe adapted for contacting said current conducting means in a second position of rotation.

2. A radiator according to claim 1 wherein each of said at least one cassette is allotted a pre-determined power output and that the total power output is obtained by connecting a number of cassettes, each of which may have a different power development.

3. A radiator according to claim 1, wherein one of said cassettes includes a thermostat.

4. A radiator according to claim wherein each of said at least one cassette is covered with an outer cover to reduce surface temperature.

5. A radiator according to claim 1, wherein said rails have a length which exceeds the total width of the total number of cassettes used, and which length corresponds to the total length of the radiator.

6. A radiator according to claim 5, wherein the end portions of the contact rail are provide with end covers.

7. A radiator according to claim 1 wherein each of said at least one cassette comprises a casing for enclosing said resistance means; and connecting portions supporting said cassette from said guide rail and said contact rail and the end portions of said casings cooperating with said connecting portions.

8. A radiator according to claim wherein each of said at least one cassette is made of a material having a high heat-accumulating ability.

9. A radiator acccording to claim 1, wherein each of said at least one cassette is made of extruded aluminum.

10. A radiator according to claim 1, wherein said guide rail is spaced below said contact rail and wherein said rotatable contact means includes:

an upper connecting portion disposed on the upper end of said heating cassette engaging in said contact rail;

said upper portion having a first part held against rotation by said contact rail and a second part fixed to said heating cassette and rotatable with respect to said first part and said contact rail; and, contact means disposed in said first part adapted upon rotation of the second part and said heating cassette to be brought into contact with said current conducting means arranged in said contact rail.

11. A radiator according to claim 10, wherein said second part includes a shaft to which said first part is journaled.

12. A radiator according to claim 10, wherein said second part is arranged to rotate between limit positions and means are provided for locking said second part in position when said contact means in said first part are rotated into contact with said current conducting means.

13. A radiator according to claim 12:

further including a lower connecting portion disposed on the lower end of said heating cassette;

said lower connecting portion including a first part held against rotation by said guide rail and a second part fixed to said heating cassette and rotatable with respect to said first part and said guide rail;

locking means for locking said lower connecting portion second part in position when said heating cassette is rotated to permit contact means in said upper connecting portion first part to contact said current conducting means;

whereby common actuation of the upper connecting portion locking means and the lower connecting portion locking means is required for rotation of the heating cassette to permit the contact means in said upper connecting portion first part to be rotated out of contact with said current conducting means.

14. A radiator according to claim 13, further including means for spacing adajcent heating cassettes disposed on said heating cassettes and arranged in at least one of the contact rail and the guide rail to the part thereof which is not covered by a cassette.

15. A radiator according to claim 13, wherein the locking means comprises a peg disposed on said connecting portions which can snap into a recess arranged in a confronting surface of the heating cassette.

16. A radiator according to claim 13, wherein said locking means disposed on said upper and lower connecting portions include means whereby the locking means may be unlocked.

* * * * *